US010488142B2

(12) United States Patent
Jacobson

(10) Patent No.: US 10,488,142 B2
(45) Date of Patent: Nov. 26, 2019

(54) FIREARM VISE BLOCK

(71) Applicant: Revo Brand Group, LLC, Plymouth, MN (US)

(72) Inventor: Ryan Jacobson, Minneapolis, MN (US)

(73) Assignee: Revo Brand Group, LLC, Plymouth, MN (US)

( * ) Notice: Subject to any disclaimer, the term of this patent is extended or adjusted under 35 U.S.C. 154(b) by 0 days.

(21) Appl. No.: 16/148,627

(22) Filed: Oct. 1, 2018

(65) Prior Publication Data

US 2019/0162499 A1 May 30, 2019

Related U.S. Application Data

(60) Provisional application No. 62/590,816, filed on Nov. 27, 2017.

(51) Int. Cl.

| | |
|---|---|
| ***F41A 23/18*** | (2006.01) |
| *F41A 11/00* | (2006.01) |
| *F41A 9/65* | (2006.01) |

(52) U.S. Cl.

CPC ..... *F41A 23/18* (2013.01); *F41A 9/65* (2013.01); *F41A 11/00* (2013.01)

(58) Field of Classification Search

CPC ..... F41A 23/16; F41A 23/18; F41A 29/00
USPC ..... 42/70.02
See application file for complete search history.

(56) References Cited

U.S. PATENT DOCUMENTS

| | | | | |
|---|---|---|---|---|
| 4,528,765 | A | 7/1985 | Johnson | |
| 4,542,606 | A * | 9/1985 | Hoenig | F41A 21/487 42/75.02 |
| 4,605,140 | A | 8/1986 | Koors | |
| 4,619,062 | A | 10/1986 | Johnson | |
| 4,628,627 | A | 12/1986 | Johnson | |
| 4,709,496 | A | 12/1987 | Johnson | |
| 4,896,447 | A | 1/1990 | Badoni | |
| 5,014,866 | A | 5/1991 | Moore | |
| 5,208,937 | A | 5/1993 | Cooper | |
| 5,518,033 | A | 5/1996 | Webster | |
| 5,782,029 | A | 7/1998 | Brooks | |
| 6,032,695 | A | 3/2000 | Wellen et al. | |
| D427,274 | S | 6/2000 | Hicks | |
| 6,256,920 | B1 | 7/2001 | Olson | |
| 6,536,152 | B1 | 3/2003 | Wisz | |
| 6,761,101 | B1 | 7/2004 | Luth | |
| 7,891,129 | B2 | 2/2011 | Parry, Jr. et al. | |
| 8,590,203 | B1 | 11/2013 | McCarthy et al. | |
| 8,931,201 | B2 | 1/2015 | Gianladis et al. | |
| D738,984 | S | 9/2015 | Mayberry et al. | |
| 2006/0185658 | A1 | 8/2006 | Stevens | |
| 2010/0071242 | A1 | 3/2010 | Lesenfants | |

(Continued)

*Primary Examiner* — Stephen Johnson
(74) *Attorney, Agent, or Firm* — Grumbles Law PLLC; Brittany Nanzig

(57) ABSTRACT

A firearm vise block can include a block body and an adjustment mechanism. The block body can include a first side structured and configured to be clamped between jaws of a bench vise, and a second side can be structured and configured to fit within an ammunition magazine well of a firearm. The second side can be adjustable between at least an insertion state and an expanded state. The adjustment mechanism can be structured and configured to selectively and reversibly move the second side between the insertion state and the expanded state.

14 Claims, 6 Drawing Sheets

(56) References Cited

U.S. PATENT DOCUMENTS

| | | | | |
|---|---|---|---|---|
| 2011/0173868 | A1* | 7/2011 | Wilson | F41A 23/18<br>42/95 |
| 2012/0085009 | A1 | 4/2012 | Crow | |
| 2015/0290775 | A1 | 10/2015 | Bennett et al. | |
| 2018/0112947 | A1* | 4/2018 | Reik | F41A 23/18 |

* cited by examiner

FIREARM VISE BLOCK

CROSS-REFERENCE TO RELATED APPLICATION

This application claims the benefit of U.S. Provisional Application Ser. No. 62/590,816, filed on Nov. 27, 2017, titled FIREARM VISE BLOCK.

FIELD OF THE INVENTION

This disclosure relates to firearm maintenance aids, and more particularly, relates to vise blocks for firearm maintenance.

BACKGROUND OF THE INVENTION

During maintenance activities, firearms such as rifles (or sub-components thereof) are often held or otherwise supported by clamps, jigs, or other mechanical support arrangements. This can free up an armorer's hands for performing maintenance tasks, and can provide more secure support than, for example, handholding. Vise blocks that facilitate support of a rifle with a bench vise via attachment to the rifle's ammunition magazine well ("magwell") are known, but many such vise blocks suffer from an imprecise fit between block and magwell. It would be desirable to provide vise blocks that can provide secure support for a firearm via magwell attachment.

SUMMARY OF THE INVENTION

This disclosure relates to firearm maintenance aids, and more particularly, relates to vise blocks for firearm maintenance. In an illustrative but non-limiting example, the disclosure provides a firearm vise block that can include a block body and an adjustment mechanism. The block body can include a first side structured and configured to be clamped between jaws of a bench vise, and a second side can be structured and configured to fit within an ammunition magazine well of a firearm. The second side can be adjustable between at least an insertion state and an expanded state. The adjustment mechanism can be structured and configured to selectively and reversibly move the second side between the insertion state and the expanded state.

The above summary is not intended to describe each and every example or every implementation of the disclosure. The Description that follows more particularly exemplifies various illustrative embodiments.

BRIEF DESCRIPTION OF THE DRAWINGS

The following description should be read with reference to the drawings. The drawings, which are not necessarily to scale, depict examples and are not intended to limit the scope of the disclosure. The disclosure may be more completely understood in consideration of the following description with respect to various examples in connection with the accompanying drawings, in which.

DETAILED DESCRIPTION

Figure 1:
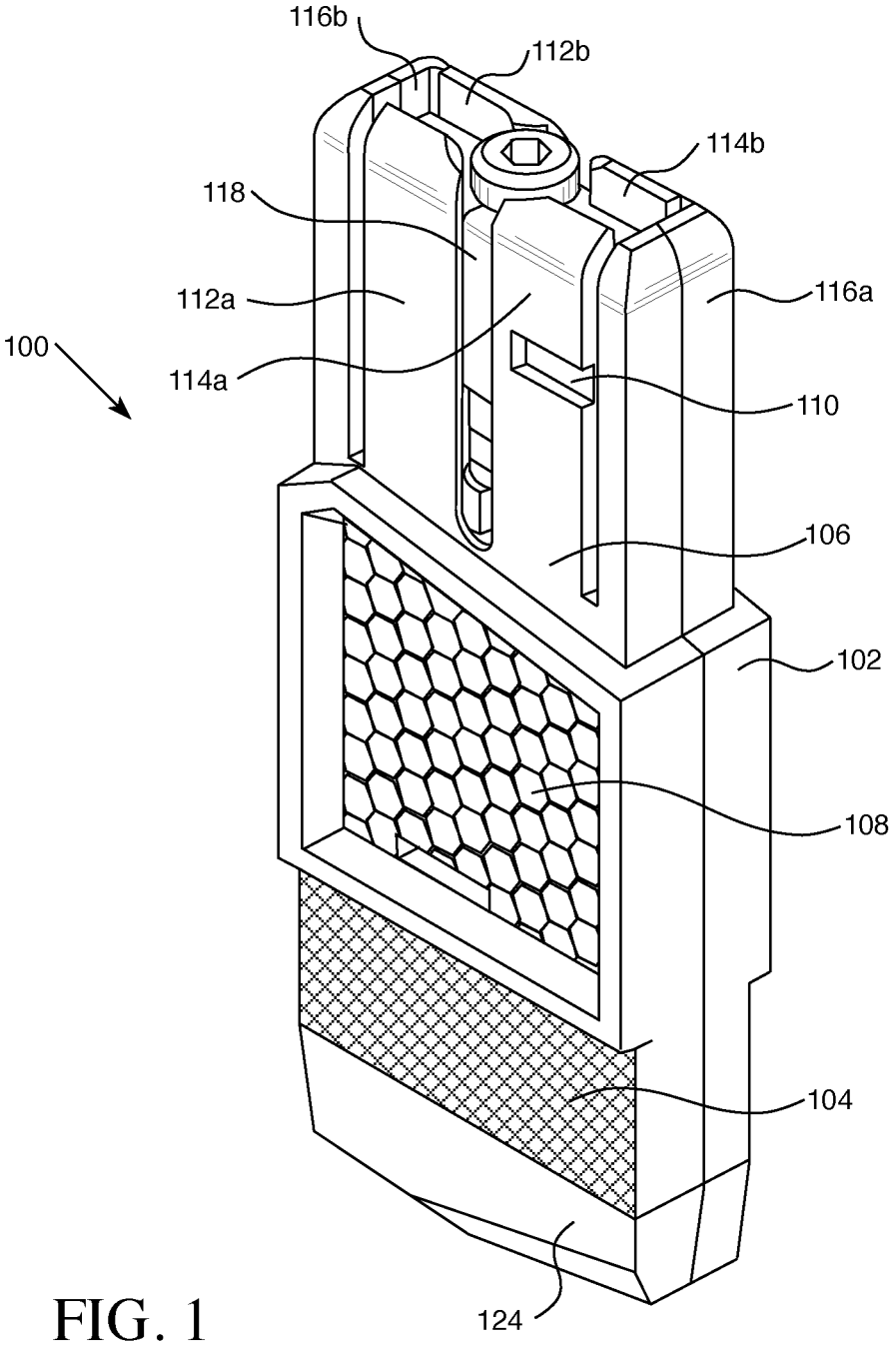
FIG. 1 is a schematic perspective view of an illustrative example of a firearm vise block of the present disclosure.

The present disclosure relates to firearm maintenance aids, and more particularly, relates to vise blocks for firearm maintenance. Various embodiments are described in detail with reference to the drawings, in which like reference numerals may be used to represent like parts and assemblies throughout the several views. Reference to various embodiments does not limit the scope of the systems and methods disclosed herein. Examples of construction, dimensions, and materials may be illustrated for the various elements, those skilled in the art will recognize that many of the examples provided have suitable alternatives that may be utilized. Any examples set forth in this specification are not intended to be limiting and merely set forth some of the many possible embodiments for the systems and methods. It is understood that various omissions and substitutions of equivalents are contemplated as circumstances may suggest or render expedient, but these are intended to cover applications or embodiments without departing from the spirit or scope of the disclosure. Also, it is to be understood that the phraseology and terminology used herein are for the purpose of description and should not be regarded as limiting.

FIG. 1 is a schematic perspective view of an illustrative example of a firearm vise block 100. Block 100 can include a block body 102, which can have a first side 104 structured and configured to be clamped between jaws of a bench vise, and can have a second side 106 structured and configured to fit within an ammunition magazine well ("magwell") of a firearm. The first side 104 and second side 106 can be connected via a central portion 108 of block body 102. In some embodiments, and as illustrated in the illustrative example of FIG. 1, first side 104 and second side 106 can be on substantially opposing ends of block body 102, but this is not necessary and other arrangements are possible. For example, in some configurations a first side and a second side can project away from a central portion of a block body at a relative right angle, or any other suitable angle.

Figure 5:
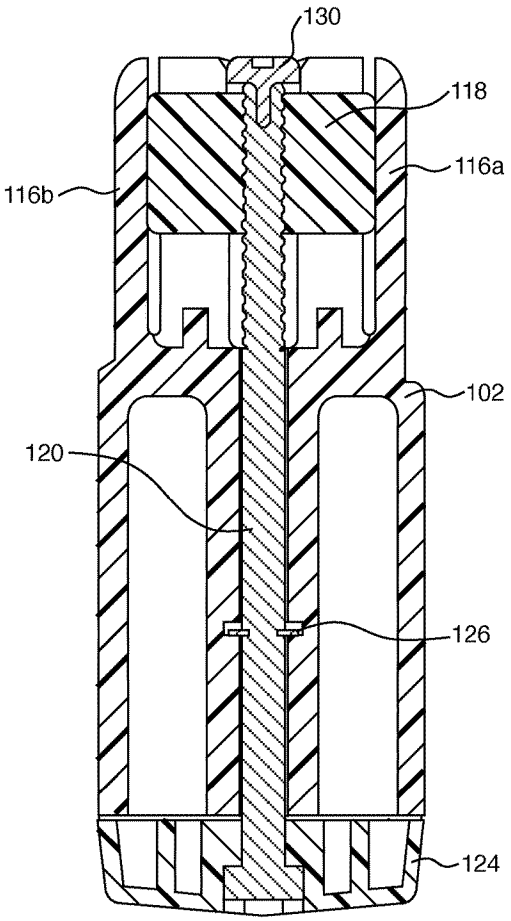
FIG. 5 is schematic a cross-sectional view of the firearm block of FIG. 1 at the cut indicated by the line 5-5 of FIG. 4.
Figure 4:
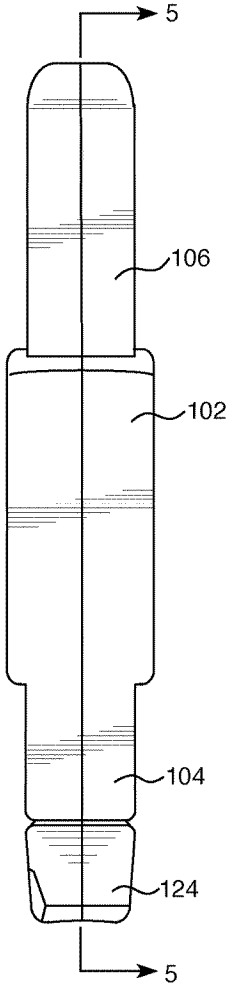
FIG. 4 is a schematic side view of another side of the firearm block of FIG. 1.
Figure 3:
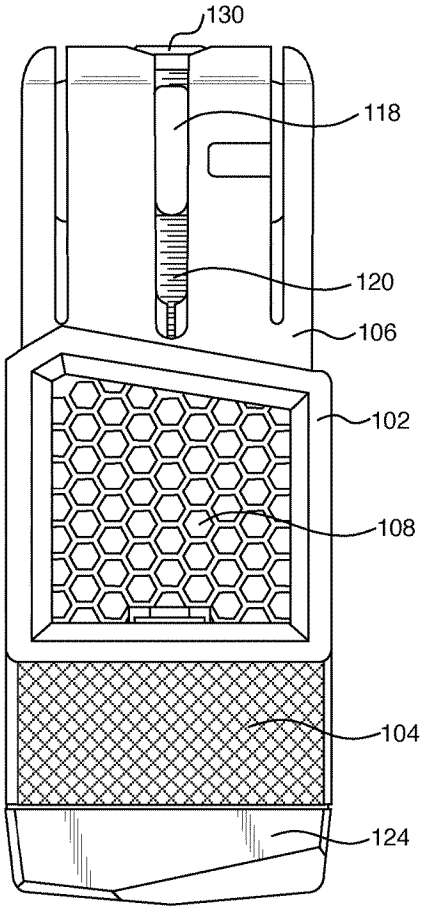
FIG. 3 is a schematic side view of the firearm block of FIG. 1.
Figure 6:
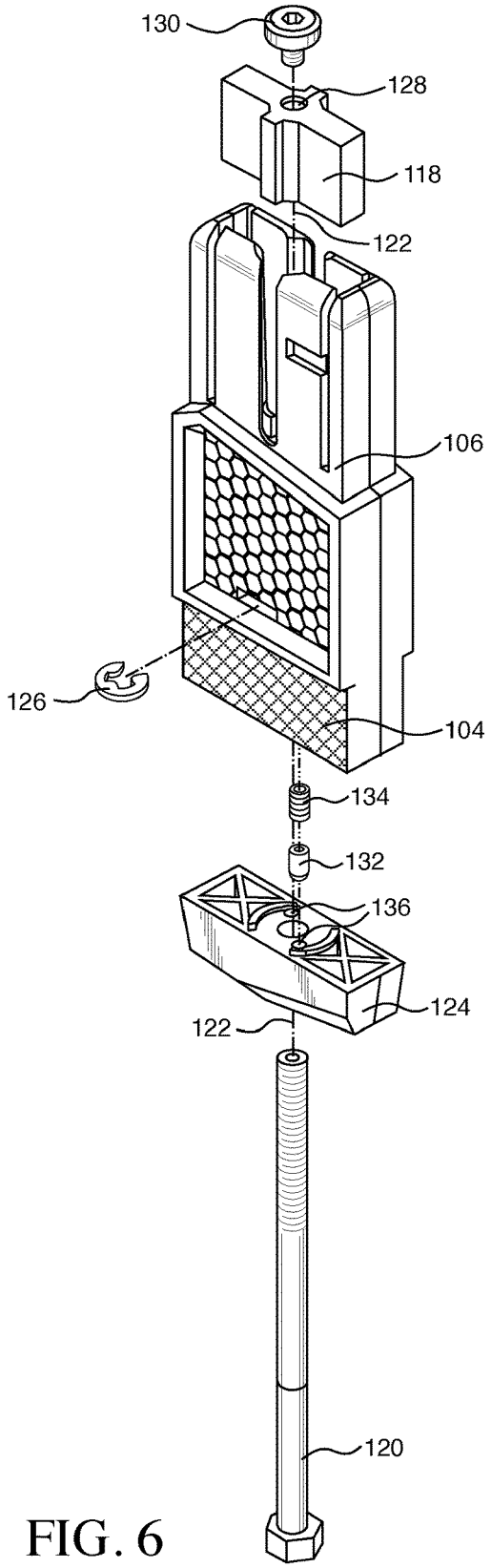
FIG. 6 is schematic exploded perspective view of the firearm block of FIG. 1.

Additional views of firearm vise block 100 are provided. FIG. 3 is a schematic side view of vise block 100. FIG. 4 is a schematic side view of a side of the vise block 100 that is substantially perpendicular to the side of FIG. 3. FIG. 5 is schematic a cross-sectional view of the vise block at the cut indicated by the line 5-5 of FIG. 4. FIG. 6 is schematic exploded perspective view of firearm vise block 100.

One or more surfaces of first side 104 can include a knurled texture or any other suitable surface finish that may enhance friction between the first side of block body 102 and jaws of a vise. In some examples, a first side of a block body can other features to provide options for the vise/block interface, such as optional vise pins (not illustrated) that can constrain the positional relationship between the block and the vise.

Second side 106 of block body 102 of firearm vise block 100 can be adjustable between at least an insertion state and an expanded state. Firearm vise block 100 can include an adjustment mechanism, described in further detail elsewhere herein, that is structured and configured to selectively and reversibly move the second side between the insertion state and the expanded state.

In the insertion state, second side 106 can be configured in a physical shape that can be readily slideably insertable into a magwell of a firearm. After insertion into the magwell in the insertion state, there can be free play between the second side 106 and the magwell. Such free play can be undesirable to an armorer when working on the firearm. Further, the same shape of the second side 106 in the insertion state that enables ready sliding coupling of the second side and the magwell can also permit ready sliding de-coupling—that is, the two may separate as easily as they come together, and thus, the firearm and the block body 102 may not be secured together when the second side is in the insertion state. In some embodiments, second side 106 of block body 102 can include a magazine lock notch 110 structured and configured to cooperate with a magazine lock mechanism of a firearm such that the firearm vise block 100 and the firearm do not readily separate when the magazine lock mechanism is locked. However, in such a locked state, free play may still be undesirably present between the vise block and the firearm.

With the second side 106 of the block body 104 in the expanded state, a magwell and vise block 100 whose second side has been inserted into the magwell can be mutually secured essentially without free play that is perceptible to a human armorer. As described further herein, second side 106 can have one or more contacting portions that can be selectively and reversibly moved outwardly, such that in the expanded state, the contacting portions can be disposed further away from a central axis or region of the second side, relative to when the second side is in the insertion state. When second side 106 is in the magwell in the expanded state, the contacting portions can be outwardly disposed such that they contact interior surfaces of the magwell, with such contact sufficient to secure (via, for example, frictional forces) the block body 102 to the magwell.

Figure 2:
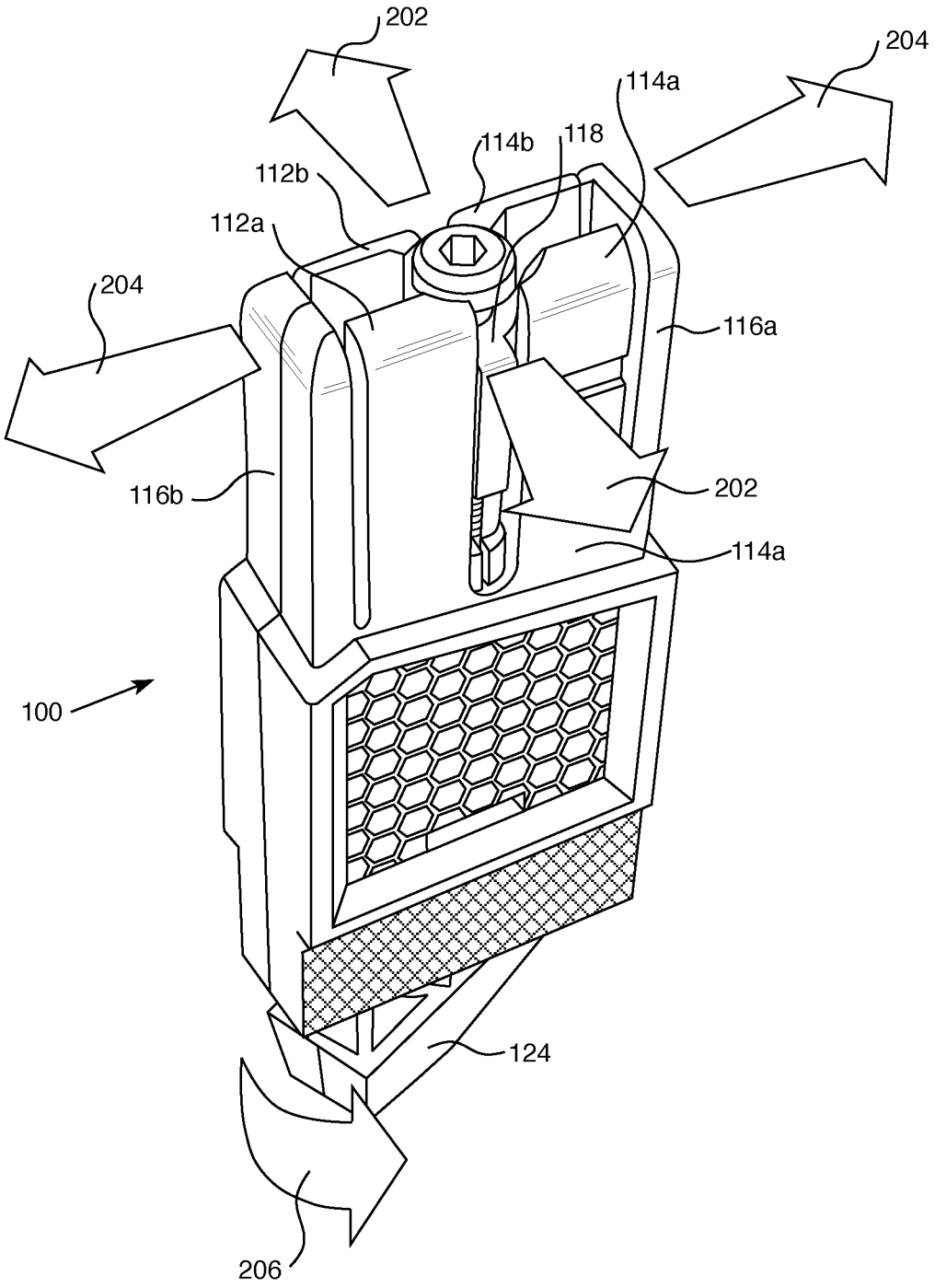
FIG. 2 is a schematic perspective view of the firearm block of FIG. 1 that indicates movement of portions of the firearm block.

For example, in the illustrative example of FIGS. 1-6, second side 106 of block body 104 can include six contacting portions 112*a*, 112*b*, 114*a*, 114*b*, 116*a*, and 116*b*. Contacting portions 112*a*, 112*b*, 114*a*, 114*b*, 116*a*, and 116*b* can be cantilevered away (toward the top of FIG. 1) from central portion 108 of block body 102. Block body 102 can be structured and configured such that contacting portions 112*a*, 112*b*, 114*a*, 114*b*, 116*a*, and 116*b* can bend or flex away and toward each other, as further discussed herein, for example as represented in FIG. 2 is a schematic perspective view of firearm block 100 that provides a cartoon illustration that indicates the movements of contacting portions 112*a*, 112*b*, 114*a*, 114*b*, 116*a*, and 116*b* as the adjustment mechanism of the vise block 100 is manipulated. In some embodiments, block body 102 can be substantially formed of or from a single or unitary piece of a resilient material, as might be produced, for example by injection molding, but this is not necessary in all embodiments. Any suitable resilient material can be used, such as (but not limited to) wood, rubber, metal, or plastic.

In the illustrative example of FIGS. 1-6, contacting portions can considered to be provided in pairs, such as the pair of 112*a* and 112*b*, the pair of 114*a* and 114*b*, and the pair of 116*a* and 116*b*. However, contacting portions need not necessarily be provided in pairs in all embodiments. Block body 102 and the adjustment mechanism (described in further detail elsewhere herein) can be structured and configured such that when the adjustment mechanism is manipulated to put the second side 104 in the expanded state, members of pairs of contacting portions (e.g., 112*a* and 112*b*) are disposed further away from each other (outward relative to the vise block), relative to when the second side is in the insertion state. Further, different pairs of contacting portions can expand or be disposed outwardly along different axes. For example, contacting portions 112*a* and 112*b* can expand or be disposed outwardly along a first axis, as suggested by arrows 202 of FIG. 2, and contacting portions 116*a* and 116*b* can expand or be disposed outwardly along a second axis, as suggested by arrows 204. (Contacting portions 114*a* and 114*b* also can expand or be disposed outwardly along the first axis suggested by arrows 202.)

The disposition of contacting portions 112*a*, 112*b*, 114*a*, 114*b*, 116*a*, and 116*b* can be controlled via the adjustment mechanism of the firearm vise block, which can be structured and configured to selectively and reversibly move the second side between the insertion state and the expanded state via human manipulation. Illustrative example vise block 100 of FIGS. 1-6 provides an example of an adjustment mechanism, but other configurations are contemplated. Some aspects of the adjustment mechanism may be most readily visually appreciated in the schematic cross-sectional view of FIG. 5 and the schematic exploded view of FIG. 6. The adjustment mechanism can include a wedge 118, a threaded post 120 (which can essentially be disposed along a central axis 122 of block body 102 and of second side 104 of the block body), and an adjustment handle 124. Threaded post 120 can be rotatably secured to block body 102. A retention clip 126 can contribute to the securing of post 120 to the block body 102, but this is not limiting. Adjustment handle 124 can be coupled to the threaded post 120 such that human manipulation of the adjustment handle can be readily translated into rotation of the threaded post. A through-hole 128 of wedge 118 can be tapped with threads complementary to threads of threaded post 120 such that rotation of the threaded post can be transformed into translation of the wedge in the up/down direction (relative to the top/bottom of sheets of FIG. 1-6) along the threaded post. A retaining fastener 130 can limit translation of wedge 118 at an upper end of travel and retain the wedge with vise block 100.

Wedge 118 can be tapered in shape with a larger top than bottom, such that when the wedge is translated downward relative to the block body 102, it can exert forces upon the cantilevered contacting portions 112*a*, 112*b*, 114*a*, 114*b*, 116*a*, and 116*b* that move them outwardly, away from each other and away from, for example, the wedge and threaded post 120 and away from central axis 122. Alternately or in addition to tapering of wedge 118, contacting portions 112*a*, 112*b*, 114*a*, 114*b*, 116*a*, and 116*b* can be tapered to result in outward motion of the contacting portions when the wedge is translated downward.

With this adjustment mechanism arrangement, wedge 118 can be reversibly movable via human manipulation (of, for example, adjustment handle 124 coupled to threaded post

120) between an insertion state position (generally, toward the top of vise block 100) and an expansion state position (generally lower than the insertion state position). In turn, the moving wedge can move the second side 104 between the insertion state and the expanded state. In the expanded state position, wedge 118 can essentially force contacting portions 112*a*, 112*b*, 114*a*, 114*b*, 116*a*, and 116*b* outwardly away from central axis 122, relative to the positions of the contacting portions in the insertion state.

The schematic perspective view of FIG. 2 provides an illustration of an operational configuration of firearm vise block 100, but this is not limiting and other configurations are possible. In the cartoon illustration of FIG. 2, handle 124 is shown as being rotated in a first direction 206. Rotation of handle 124 is transferred to rotation of threaded post 120, resulting in downward movement of wedge 118. As a result of downward motion of wedge 118 relative to block body 102, contacting portions 112*a*, 112*b*, 114*a*, 114*b*, 116*a*, and 116*b* can be essentially forced outwardly away from the central axis 122 (not illustrated in FIG. 2, but visible in FIG. 6) of vise block 100, in the directions of arrows 202, 204, as discussed elsewhere herein.

As described elsewhere herein, the outwardly positioned contacting portions 112*a*, 112*b*, 114*a*, 114*b*, 116*a*, and 116*b* can contact interior surfaces of the magwell sufficient to secure the vise block 100 to the magwell. As different magwells can vary in dimensions, the amount of outward expansion or positioning of contacting portions 112*a*, 112*b*, 114*a*, 114*b*, 116*a*, and 116*b* needed to effect securing of the of vise block 100 to different magwells can vary correspondingly. The adjustment mechanism of vise block 100 can be structured and configured to selectively and reversibly move second side 106 between the insertion state and a plurality of expanded states. In the plurality of expanded states, contacting portions 112*a*, 112*b*, 114*a*, 114*b*, 116*a*, and 116*b* can be disposed further away from the central axis 120 of the second side 106 by varying degrees, such that the plurality of expanded states accommodate varying dimensions of magwells. The plurality of expanded states can be accessed progressively by rotating adjustment handle 124 through greater amounts of rotation. In practice, a user can rotate adjustment handle 124 until a sufficiently strong or "snug" coupling is achieved between vise block 100 and a magwell. A detent mechanism can be provided, such as with detent pin 132, spring 134, and recesses 136 in adjustment handle 124, that can assist a user in positioning the adjustment handle at a rotational position aligned with clamping faces of first side 104.

When rotation of adjustment handle 124 is reversed, resilient restoring forces of block body 102 can move contacting portions 112*a*, 112*b*, 114*a*, 114*b*, 116*a*, and 116*b* back inwardly as wedge 118 move upwardly, returning the second side 106 to the insertion state (if the handle is rotated sufficiently), permitting separation of the vise block 100 from the magwell.

While the adjustment mechanism of vise block 100 is described and illustrated herein as being configured essentially to couple human manipulation of handle 124 with motion of contacting portions 112*a*, 112*b*, 114*a*, 114*b*, 116*a*, and 116*b*, other adjustment mechanism arrangements are contemplated. In some embodiments, human manipulation can be applied to an adjustment mechanism other than via a handle like handle 124. In some other embodiments, a motor can drive motion of contacting portions. In some instances, such a motor could be integrated with the vise block. In other examples, an external motor, such as of a handheld drill or screwdriver, could be temporarily coupled to an adjustment mechanism to selectively move contacting portions of a vise block.

Figure 7:
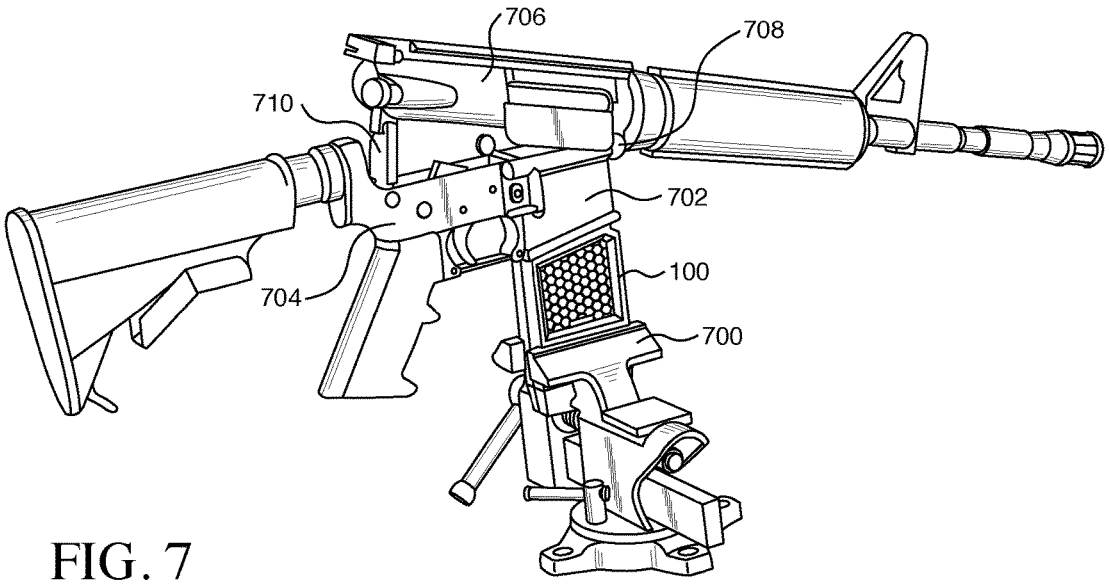
FIG. 7 is a schematic perspective illustration of the firearm block of FIG. 1 in typical use scenario with a vise and a firearm.
Figure 8:
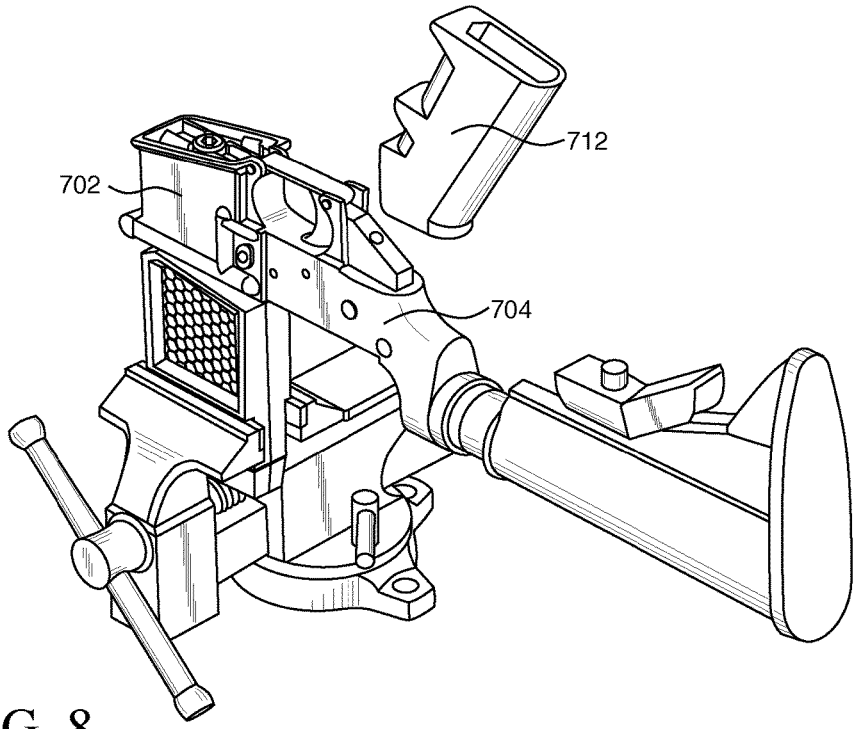
FIG. 8 is a schematic perspective illustration of the firearm block of FIG. 1 in another typical use scenario with a vise and an inverted firearm component.

FIGS. 7 and 8 are schematic perspective illustrations of vise block 100 in typical use scenarios with an AR-15 rifle or sub-components thereof. In FIG. 7, the first side (not visible) of vise block 100 is clamped in a bench vise 700, with the second side (not visible) of the block secured in magwell 702 of lower receiver 704 of an AR-15. In this view, upper receiver 706 is pivoted open via pivot pin 708. A pivot lock device 710 can engage with takedown pin receptacles of the lower 704 and upper 706 receivers to hold the rifle open for hands-free cleaning and/or other maintenance. In FIG. 8, an inverted lower receiver 704 is supported by vise block 100, whose second side (partially visible) was inserted into magwell 702 from the top side of the lower receiver rather than the bottom side (as in FIG. 7). This orientation can be convenient for tasks such as changing pistol grip 712 or any other task for which access to the underside of the rifle is desired.

Figure 9A:
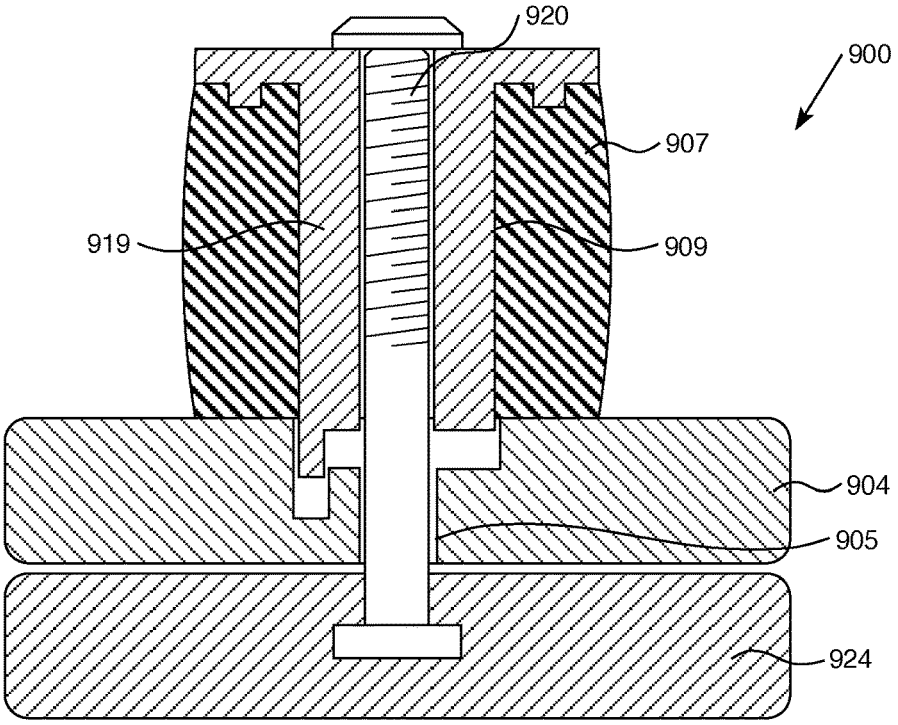
FIG. 9A is a schematic quasi cross-sectional view of another firearm vise block configured in an insertion state.
Figure 9B:
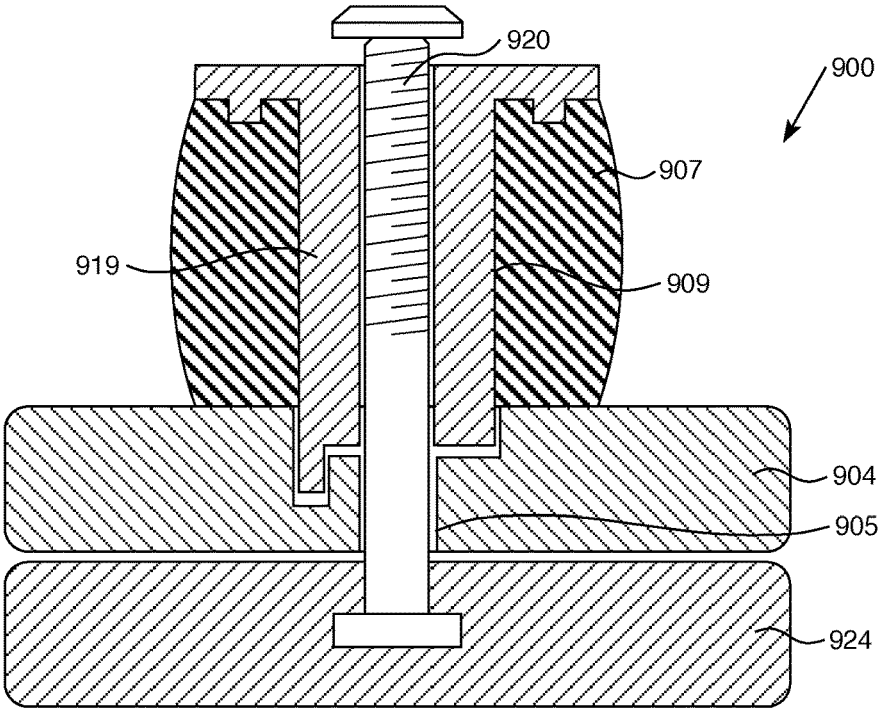
FIG. 9B is a schematic quasi cross-sectional views of the firearm vise block of FIG. 9A configured in an expanded state.

Alternative configurations of vise blocks are contemplated in the present disclosure. FIGS. 9A and 9B are schematic quasi cross-sectional views of a vise block 900 that can employ a different type of mechanism configured to move between an insertion state (FIG. 9A) and an expanded state (FIG. 9B). Vise block 900 can include a base 904, which also can be a first side of the vise block structured and configured to be clamped between jaws of a bench vise. A second side of the vise block 900 can be structured and configured to fit within a magwell of a firearm, and can include a plug 907 formed from a flexible resilient material such as a thermoplastic rubber or any other suitable material. Plug 907 can be a single piece of material having a hole 909 running from bottom to top, relative to the sheet of FIGS. 9A and 9B. A threaded post 920 can be coupled to an adjustment handle 924 and can rotatably pass through a hole 905 of base 904 and through the hole 909 of plug 907. A adjustable nut 919 can surround threaded post 920 and have threads complementary to the threads of the post such that rotation of the threaded post can be transformed into translation of the adjustable nut in the up/down direction. A retaining fastener 930 can limit translation of adjustable nut 919 at an upper end of travel. When adjustable nut 919 translates downward (in correspondence with rotation of the handle 924 and threaded post 920), the top portion of the nut (as illustrated) can press down on the plug, in effect pressing or squeezing it against the top surface of base 904. In response, flexible plug 907 can expand outwardly, as illustrated in FIG. 9B as compared with FIG. 9A. In the expanded state of FIG. 9B, the outer surfaces of flexible plug 907 can press against interior surfaces of a magwell sufficient to secure the vise block 900 to the magwell.

Persons of ordinary skill in arts relevant to this disclosure and subject matter hereof will recognize that embodiments may comprise fewer features than illustrated in any individual embodiment described by example or otherwise contemplated herein. Embodiments described herein are not meant to be an exhaustive presentation of ways in which various features may be combined and/or arranged. Accordingly, the embodiments are not mutually exclusive combinations of features; rather, embodiments can comprise a combination of different individual features selected from different individual embodiments, as understood by persons of ordinary skill in the relevant arts. Moreover, elements described with respect to one embodiment can be implemented in other embodiments even when not described in such embodiments unless otherwise noted. Although a dependent claim may refer in the claims to a specific combination with one or more other claims, other embodiments can also include a combination of the dependent claim with the subject matter of each other dependent claim or a combination of one or more features with other dependent or independent claims. Such combinations are proposed herein unless it is stated that a specific combination is not intended. Furthermore, it is intended also to include features of a claim in any other independent claim even if this claim is not directly made dependent to the independent claim.

Any incorporation by reference of documents above is limited such that no subject matter is incorporated that is contrary to the explicit disclosure herein. Any incorporation by reference of documents above is further limited such that no claims included in the documents are incorporated by reference herein. Any incorporation by reference of documents above is yet further limited such that any definitions provided in the documents are not incorporated by reference herein unless expressly included herein.

For purposes of interpreting the claims, it is expressly intended that the provisions of Section 112, sixth paragraph of 35 U.S.C. are not to be invoked unless the specific terms "means for" or "step for" are recited in a claim.

What is claimed is:

1. A firearm vise block, comprising:

a block body, the block body having:

a first side structured and configured to be clamped between jaws of a bench vise;

a second side structured and configured to fit within an ammunition magazine well of a firearm, the second side being adjustable between at least an insertion state and an expanded state;

at least two contacting portions expandable outward along a first axis;

at least two additional contacting portions expandable outward along a substantially different second axis, and an adjustment mechanism selectively and reversibly expands both the at least two contacting portions outward along the first axis and the at least two additional contacting portions outward along the substantially different second axis thereby causing the second side of the block body to move from the insertion state to the expanded state.

2. The block of claim 1, wherein the first side and the second side are on substantially opposing ends of the block body.

3. The block of claim 1, wherein:

in the insertion state, the second side is readily slideably insertable into the ammunition magazine well; and when in the expanded state, one or more contacting portions of the second side are disposed further away from a central axis of the second side, relative to when in the insertion state, such that when the second side is inside the ammunition magazine well when in the expanded state, the contacting portions contact interior surfaces of the ammunition magazine well sufficient to secure the block body to the ammunition magazine well.

4. The block of claim 3, wherein the adjustment mechanism is structured and configured to reversibly move the second side of the block body between the insertion state and a plurality of expanded states, wherein among the plurality of expanded states, the one or more contacting portions are disposed further away from the central axis of the second side by varying degrees, such that the plurality of expanded states accommodate varying dimensions of ammunition magazine wells.

5. The block of claim 3, wherein when the block body and the ammunition magazine well are mutually secured with the second side of the block body in the expanded state, they are so secured essentially without perceptible free play.

6. The block of claim 3, wherein:

the block body is substantially formed of a single piece of a resilient material; and the one or more contacting portions are cantilevered away from a central portion of the body block.

7. The block of claim 6, wherein the adjustment mechanism includes a wedge selectively movable via human manipulation that moves the second side between the insertion state and the expanded state.

8. The block of claim 7, wherein the adjustment mechanism further includes:

a threaded post rotatably secured to the block body; and an adjustment handle coupled to the threaded post such that human manipulation of the adjustment handle is readily translated into rotation of the threaded post; and wherein the wedge is tapped with threads complementary to the threaded post such that rotation of the threaded post is transformed into translation of the wedge.

9. The block of claim 8, wherein the adjustment mechanism is structured and configured such that the wedge is reversibly moveable between an insertion state position and an expansion state position by human manipulation of the adjustment handle, and via the threaded post, wherein when in the expanded state position, the wedge forces the one or more contacting portions further away from the central axis of the second side, relative to when in the insertion state position.

10. The block of claim 6, wherein the one or more contacting portions include a first pair of contacting portions that, when in the expanded state, are disposed further away from each other, relative to when in the insertion state.

11. The block of claim 10, wherein the one or more contacting portions further include a second pair of contacting portions that, when in the expanded state, are disposed further away from each other, relative to when in the insertion state.

12. The block of claim 1, wherein the second side of the block body includes a magazine lock notch structured and configured to cooperate with a magazine lock mechanism of the firearm.

13. The block of claim 1, wherein the adjustment mechanism is structured and configured to selectively and reversibly move the second side between the insertion state and the expanded state via human manipulation.

14. The block of claim 1, wherein the adjustment mechanism is structured and configured to selectively and reversibly move the second side between the insertion state and the expanded state under power provided by a motor.

* * * * *